US007137265B2

(12) United States Patent
Kim

(10) Patent No.: US 7,137,265 B2
(45) Date of Patent: Nov. 21, 2006

(54) APPARATUS AND METHOD FOR CONTROLLING OIL OF AIR CONDITIONER

(75) Inventor: Cheol Min Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 101 days.

(21) Appl. No.: 10/828,179

(22) Filed: Apr. 21, 2004

(65) Prior Publication Data

US 2005/0076657 A1 Apr. 14, 2005

(30) Foreign Application Priority Data

Oct. 10, 2003 (KR) ..... 10-2003-0070732

(51) Int. Cl.

| | |
|---|---|
| ***F25B 31/00*** | (2006.01) |
| ***F25B 1/00*** | (2006.01) |
| ***F25B 49/00*** | (2006.01) |
| ***F04B 41/06*** | (2006.01) |
| ***F04B 17/00*** | (2006.01) |

(52) U.S. Cl. ..... 62/192; 62/228.5; 62/468; 62/510; 417/7; 417/372

(58) Field of Classification Search ..... 62/84, 62/157, 175, 192, 193, 228.5, 468, 510; 417/372, 417/3, 5, 6, 7

See application file for complete search history.

(56) References Cited

U.S. PATENT DOCUMENTS

| | | | | |
|---|---|---|---|---|
| 4,614,089 | A * | 9/1986 | Dorsey | 62/158 |
| 4,870,831 | A * | 10/1989 | Kitamoto | 62/84 |
| 4,932,220 | A * | 6/1990 | Inoue | 62/175 |
| 5,050,397 | A * | 9/1991 | Sugiyama et al. | 62/175 |
| 5,094,598 | A | 3/1992 | Amata et al. | |
| 5,245,837 | A * | 9/1993 | Kitamoto | 62/175 |
| 5,996,363 | A * | 12/1999 | Kurachi et al. | 62/192 |
| 6,519,957 | B1 | 2/2003 | Huh et al. | |
| 2003/0233837 | A1 | 12/2003 | Lee et al. | |
| 2004/0003605 | A1 | 1/2004 | So et al. | |
| 2004/0003606 | A1 | 1/2004 | So et al. | |
| 2004/0107709 | A1 | 6/2004 | Lee et al. | |
| 2005/0072183 | A1 * | 4/2005 | Takashi | 62/468 |

FOREIGN PATENT DOCUMENTS

| | | |
|---|---|---|
| EP | 0403239 | 12/1990 |
| JP | 1-203855 | 8/1989 |
| JP | 5-256532 | 10/1993 |
| JP | 7-318175 | 12/1995 |
| JP | 2004-116805 | 4/2004 |

OTHER PUBLICATIONS

English language Abstract of JP 2004-116805.
English language Abstract of JP 5-256532.
English language Abstract of JP 1-203855.
English Language Abstract of JP 7-318175.

* cited by examiner

*Primary Examiner*—Marc Norman
(74) *Attorney, Agent, or Firm*—Greenblum & Bernstein, P.L.C.

(57) ABSTRACT

An apparatus and a method for controlling oil of a multi-compressor installed in an air conditioner includes a micro-computer for sequentially stopping compressors installed in the air conditioner for a preset time and then sequentially operating the compressors when the preset time elapses; and oil pipes connected to the compressors and balancing oil in the compressors, so that damage of the compressors due to imbalance of refrigerating machine oil is prevented by uniformly dividing oil of a multi-compressor installed in the air conditioner.

2 Claims, 7 Drawing Sheets

APPARATUS AND METHOD FOR CONTROLLING OIL OF AIR CONDITIONER

BACKGROUND OF THE INVENTION

1. Field of the Invention

The present invention relates to an air conditioner, and particularly, to an apparatus and a method for controlling oil of an air conditioner.

2. Description of the Prior Art

In general, an air conditioner cools warm air or heats cool air in a room. Hereinafter, a construction of an air conditioner having two compressors in accordance with a conventional art will now be described with reference to FIG. 1. Herein, the two compressors are selectively operated according to a cooling load of a room.

FIG. 1 is a block diagram showing a construction of an air conditioner having two compressors in accordance with the conventional art.

As shown therein, an air conditioner having two compressors includes a first compressor 18A and a second compressor 18B selectively operated according to a cooling load of a room to vary compressing capacity; a condenser 1 for radiating heat of a refrigerant compressed by the first and second compressors 18A, 18B; an expansion valve 2 for expanding the refrigerant discharged from the condenser 1; and an evaporator 3 receiving the refrigerant expanded by the expansion valve 3 and generating cool air. Assuming that the first compressor 18A is a compressor of small compressing capacity and the second compressor 18B is a compressor of high compressing capacity, the construction of the air conditioner having the two compressors will now be described.

First, suction pipes 9, 13 respectively connected to the first compressor 18A and the second compressor 18B are connected by hoses 5, 7 diverged from a suction hose 4 connected to the evaporator 3. In addition, discharge pipes 11, 14 respectively connected to the first compressor 18A and the second compressor 18B are connected by hoses 10, 16 diverged from a discharge hose 17 connected to the condenser 1.

To the diverged hoses 5, 7, 10, 16 are respectively connected suction valves 6, 8 and discharge valves 12, 15 which are selectively opened/closed by hand or a control means such as a microcomputer or the like.

Accordingly, the air conditioner having the two compressors controls a cooling cycle by operating the first compressor 18A or/and the second compressor 18B according to the cooling load. That is, capacities of the compressors are changed in such a manner than the air conditioner operates only the first compressor 18A when an indoor cooling load is small, operates only the second compressor 18B when the indoor cooling load is large, and operates both the first and second compressors 18A, 18B when the indoor cooling load is maximum.

When a refrigerant is compressed by the first compressor 18A and/or the second compressor 18B, refrigerating machine oil in the first and second compressor 18A, 18B is mixed with the refrigerant to perform a cooling cycle and then is sucked into the first and second compressors 18A, 18B via an accumulator (not shown).

Recently, an air conditioner having four compressors has been used. General operations of the air conditioner having four compressors are the same as those of the air conditioner of FIG. 1. The four compressors may be designed to have the same compressing capacity or may be designed to have different compressing capacities.

However, when the four compressors are operated according to the conventional art, most of refrigerating machine oil is sucked into a certain compressor, thereby causing insufficiency of refrigerating machine oil in other compressors. That is, the amount of the refrigerating machine oil collected in a common accumulator is slightly different depending on suction pipe laying and performance variations of the compressors. In case of simultaneously operating four compressors for many hours, refrigerating machine oil in compressors is not uniform, thereby causing damage of compressors having insufficient refrigerating machine oil.

An air conditioner having a multi-compressor in accordance with the conventional art is disclosed in detail in U.S. Pat. No. 6,519,957 issued in Feb. 18, 2003.

SUMMARY OF THE INVENTION

Therefore, an object of the present invention is to provide an apparatus and a method for controlling oil of an air conditioner capable of preventing damage of a compressor due to imbalance of refrigerating machine oil by uniformly dividing oil of a multi-compressor installed in the air conditioner.

To achieve these and other advantages and in accordance with the purpose of the present invention, as embodied and broadly described herein, there is provided an apparatus for controlling oil of an air conditioner including: a microcomputer sequentially stopping compressors installed in an air conditioner for a preset time, and then sequentially operating the compressors when the preset time elapses; and oil pipes connected to the compressors and balancing oil in the compressors.

To achieve these and other advantages and in accordance with the purpose of the present invention, as embodied and broadly described herein, there is provided an apparatus for controlling oil of an air conditioner including: a microcomputer sequentially stopping compressors installed in the air conditioner for a preset time when an operation time of the air conditioner passes a preset time and thus a mode of the air conditioner is changed to an oil control mode, and then sequentially operating the compressors when the preset time elapses; oil pipes connected to the compressors and balancing oil in the compressors; and an equalizer for maintaining internal pressure of the compressors the same in order to smoothly balance oil in the compressors.

To achieve these and other advantages and in accordance with the purpose of the present invention, as embodied and broadly described herein, there is provided a method for controlling oil of an air conditioner including: sequentially stopping compressors installed in an air conditioner for a preset time when a mode of the air conditioner is changed to an oil control mode; and sequentially operating the compressors when the preset time elapses, wherein oil pipes for balancing oil in the compressors are connected to the compressors.

To achieve these and other advantages and in accordance with the purpose of the present invention, as embodied and broadly described herein, there is provided a method for controlling oil of an air conditioner including: comparing an operation time of each compressor and a preset refrigerating machine oil shortage time while the compressors are operated in a cooling mode or a heating mode of the air conditioner; changing a mode of the air conditioner to an oil control mode when the operation time of each compressor passes the preset refrigerating machine oil shortage time, and then sequentially stopping the compressors for a preset stopping time; and sequentially operating the compressors when the preset stopping time elapses, and then changing the oil control mode to the cooling mode or the heating mode, wherein the compressors are connected to each other through oil pipes.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Hereinafter, preferred embodiments of an oil control apparatus of a multi-compressor installed in an air conditioner and its method capable of preventing damage of compressors due to the imbalance of the amount of refrigerating machine oil between the compressors, by uniformly dividing the oil in the multi-compressor installed in the air conditioner, will now be described with reference to FIGS. 2 through 6.

Figure 1:
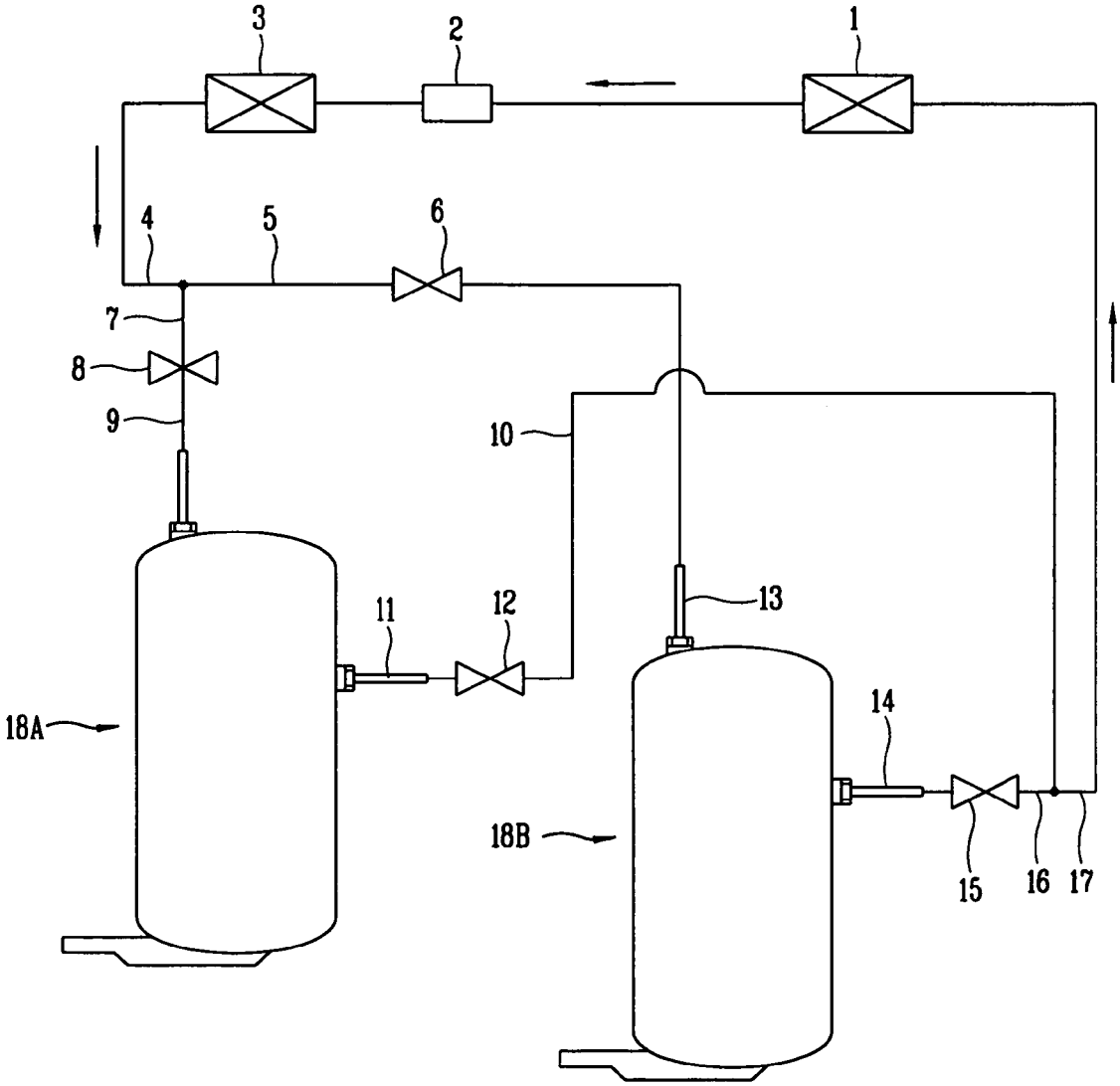
FIG. 1 PRIOR ART
FIG. 1 is a block diagram showing a construction of an air conditioner having two compressors in accordance with the conventional art.
Figure 2:
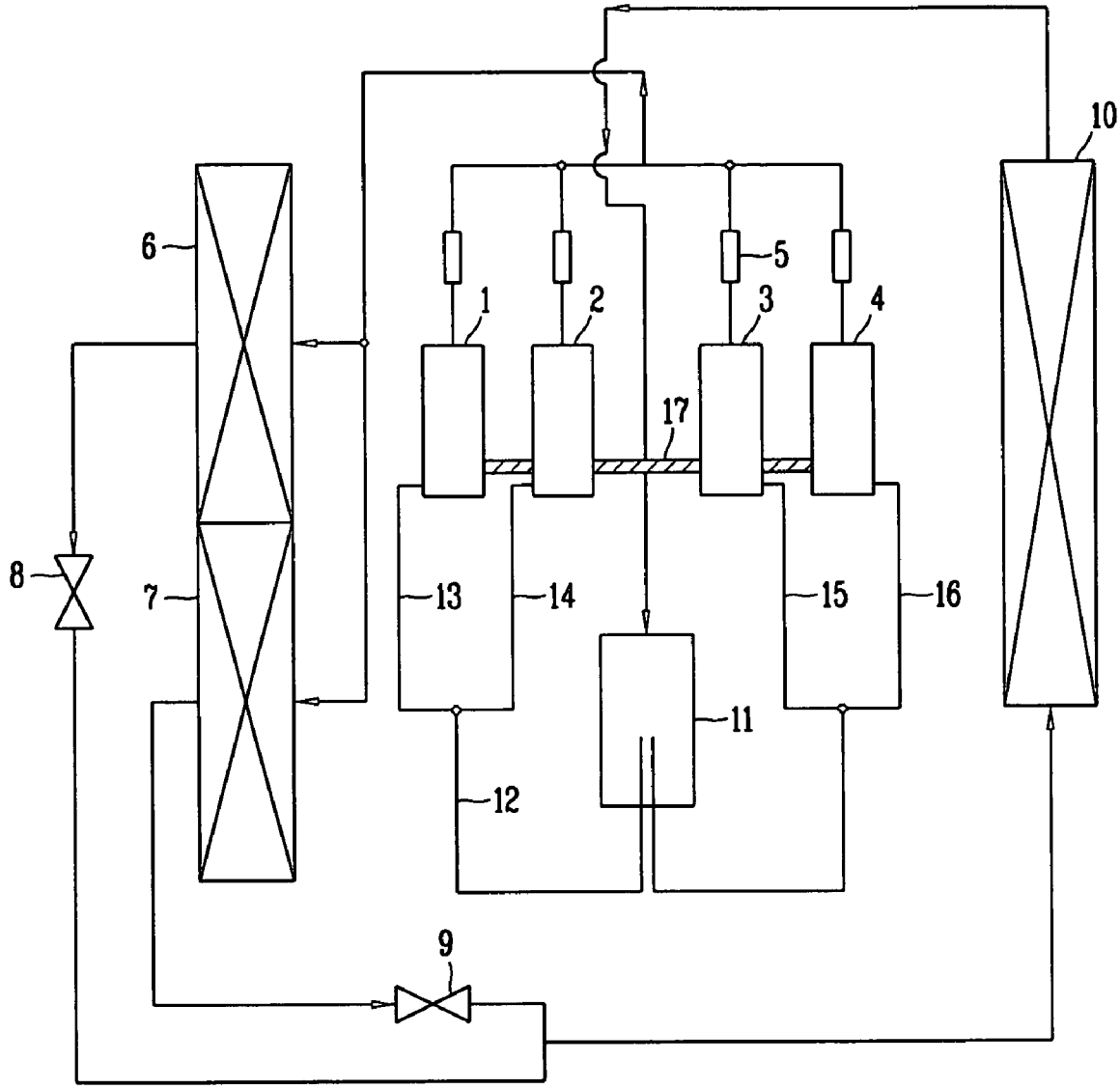
FIG. 2 is a block diagram showing a construction of an air conditioner having a multi-compressor to which an oil control apparatus is applied in accordance with a first embodiment of the present invention.

FIG. 2 is a block diagram showing a construction of an air conditioner having a multi-compressor to which an oil control apparatus is applied in accordance with a first embodiment of the present invention.

As shown therein, an air conditioner having a multi-compressor (e.g., four compressors) in accordance with the first embodiment of the present invention includes first~fourth compressors 1~4; a check valve 5; outdoor heat exchangers 6, 7; first and second expansion valves 8. 9; an indoor heat exchanger 10; an accumulator 11; a divergence pipe 12; first~fourth suction pipes 13~16; oil pipes 17; an equalizer (not shown); and a microcomputer (not shown). Herein, the construction of an air conditioner having a multi-compressor (e.g., four compressors) in accordance with the first embodiment of the present invention is the same as the above mentioned air conditioner, except oil pipes 17 connected to the first~fourth compressors 1~4 and uniformly dividing the refrigerating machine oil; the equalizer; and the microcomputer. Thus, descriptions on the same construction will be omitted. Herein, the first~fourth compressors are connected to one another through the oil pipes 17. That is, hereinafter, an apparatus and a method for controlling oil of a multi-compressor installed in the air conditioner, in accordance with a first embodiment of the present invention, will now be described in detail.

An apparatus for controlling oil of a multi-compressor installed in the air conditioner, in accordance with the first embodiment of the present invention includes a microcomputer sequentially stopping the first~fourth compressors 1~4 installed in the air conditioner for a preset time when a mode of the air conditioner is changed to an oil control mode, and then sequentially operating the first~fourth compressors 1~4 when the preset time elapses; oil pipes connected to each of first~fourth compressors in order that the amount of refrigerating machine oil in the first~fourth compressors maintains a normal level and is balanced; an equalizer for maintaining the same pressure in the first~fourth compressors in order to smoothly divide the refrigerating machine oil in the first~fourth compressors.

That is, in the apparatus for controlling oil (e.g., refrigerating machine oil) of a multi-compressor (e.g., four compressors) installed in the air conditioner in accordance with the first embodiment of the present invention, even if the refrigerating machine oil mixed with a refrigerant in the first~fourth compressors 1~4 is sucked only into the first compressor 1 after performing a cooling or warming cycle, the certain amount of refrigerating machine oil is supplied to the second~fourth compressors 2~4 through the oil pipes 17. In addition, in order to smoothly supply the refrigerating machine oil, the first~fourth compressors 1~4 are connected by the equalizer (not shown) to thereby make inner pressures the same. For example, in order to uniformly divide the refrigerating machine oil in the first~fourth compressors through the oil pipes 17, the four compressors are sequentially stopped, and then when predetermined time elapses, the first~fourth compressors 1~4 are sequentially operated, so that the refrigerating machine oil in the first~fourth compressors 1~4 is uniformly distributed through the oil pipes 17 connected to the first~fourth compressors 1~4.

Operations of the apparatus for controlling oil of a multi-compressor in the air conditioner, in accordance with the first embodiment of the present invention will now be described.

First, when an operation time of each of the first~fourth compressors 1~4 operated according to a cooling mode or a heating mode passes a preset refrigerating machine shortage time (e.g., two-hour), the microcomputer changes a mode of the air conditioner to an oil control mode.

When the mode of the air conditioner is changed to the oil control mode, the microcomputer sequentially stops the first~fourth compressors 1~4 installed in the air conditioner for a preset time (e.g., one minute), and then, when the preset time elapses, the microcomputer sequentially operates the first~fourth compressors 1~4. At this time, the certain amount of the refrigerating machine oil in the stopped compressor (e.g., first compressor) is sucked into the compressors (e.g., second fourth compressors) in operation through the oil pipes 17 connected to the first~fourth compressors 1~4. Accordingly, damage of the compressors (second~forth compressors) in operation, due to insufficient refrigerating machine oil can be prevented.

For example, when a mode of the oil conditioner is changed to the oil control mode, the microcomputer stops the first compressor 1 of the first~fourth compressors 1~4 installed in the air conditioner for one minute, and then when the one minute elapses, the microcomputer operates the first compressor 1. After operating the first compressor 1, the microcomputer stops the second compressor 2 for one minute. When the one-minute elapses, the microcomputer operates the second compressor 2, and after operating the second compressor 2, the microcomputer stops the third compressor 3 for one minute. When the one-minute elapses, the microcomputer operates the third compressor 3, and after operating the third compressor 3, the microcomputer stops the fourth compressor 4 for one minute. When the one-minute elapses, the microcomputer operates the fourth compressor. Accordingly, when one of four compressors is stopped, the certain amount of refrigerating machine oil in a stopped compressor is sucked into the compressor in operation through the oil pipes 17. For this reason, the compressors having insufficient refrigerating machine oil can be prevented from being damaged, which occurs because refrigerating machine oil non-uniformly exists in the compressors when four compressors are simultaneously operated for a long time.

Herein, the equalizer is a pipe for maintaining the internal pressure of the first~fourth compressors the same in order that the refrigerating machine oil in the first~fourth compressors 1~4 is smoothly exchanged, but it is not an essential component. That is, the refrigerating machine oil in the first~fourth compressors is properly exchanged through the oil pipes 17 even without the equalizer.

Hereinafter, a construction of an air conditioner having a multi-compressor including an oil control apparatus in accordance with a second embodiment of the present invention will now be described.

Figure 3:
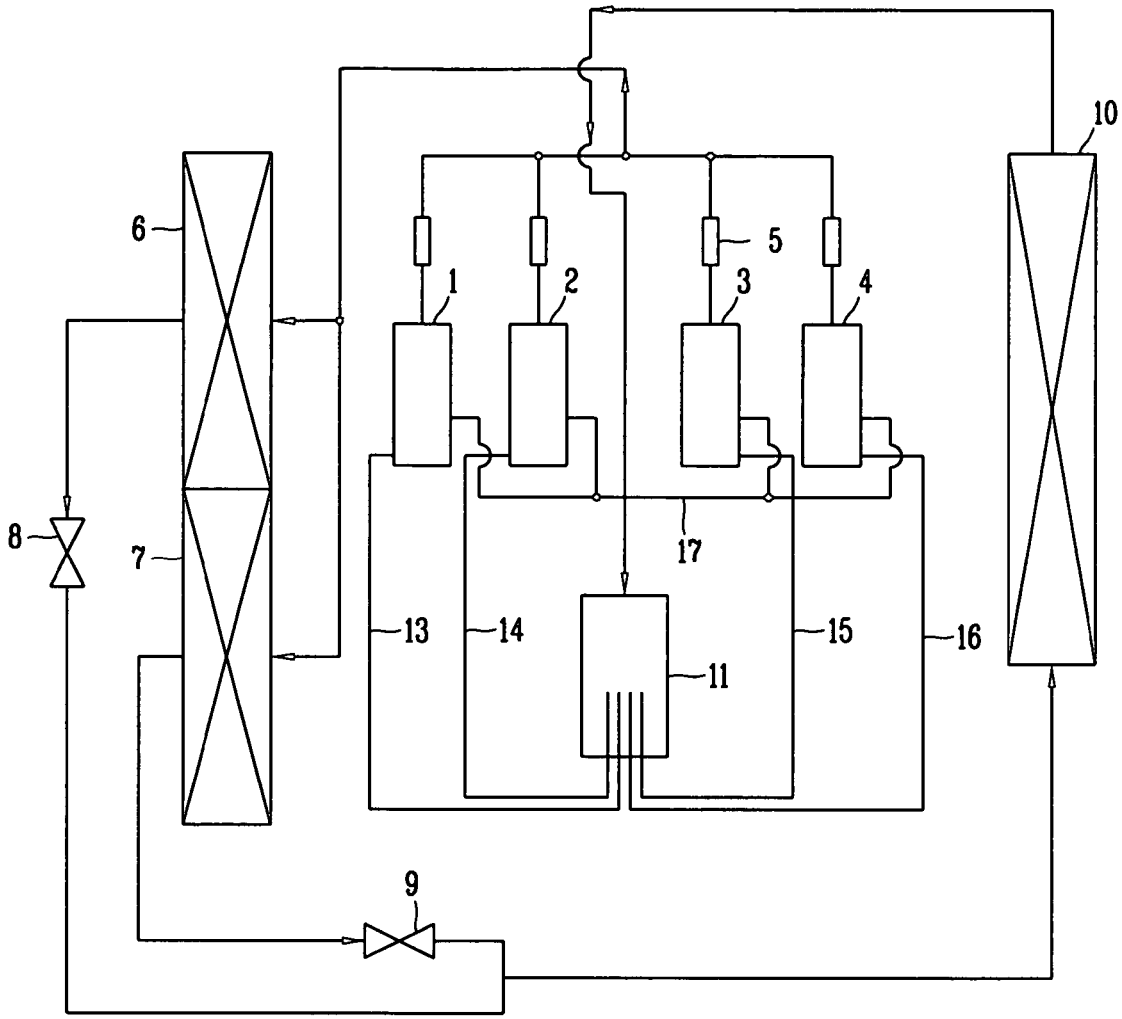
FIG. 3 is a block diagram showing a construction of an air conditioner having a multi-compressor to which an oil control apparatus is applied in accordance with a second embodiment of the present invention.

FIG. 3 is a block diagram showing a construction of an air conditioner having a multi-compressor including an oil control apparatus in accordance with a second embodiment of the present invention.

As shown therein, an apparatus for controlling oil of a multi-compressor installed in an air conditioner in accordance with the second embodiment of the present invention includes a microcomputer for sequentially stopping first~fourth compressors 1~4 installed in the air conditioner for a preset time when a mode of the air conditioner is changed to an oil control mode, and then sequentially operating the first~fourth compressors when the preset time elapses; and oil pipes connected to the first~fourth compressors in parallel in order that the amount of refrigerating machine oil in the first~fourth compressors maintains a normal level and is balanced. That is, in the apparatus for controlling oil of a multi-compressor installed in the air conditioner in accordance with the second embodiment of the present invention, the oil pipes 17 are connected to the first—fourth compressors in parallel, thereby uniformly dividing the refrigerating machine oil. In addition, the divergence pipe 12 is not used in the air conditioner in accordance with the second embodiment of the present invention, and first~fourth suction pipes 13~16 respectively connected to the first~fourth compressors are directly connected to the accumulator 11, so that the first~fourth suction pipe 13~16 can be easily welded. Since an operation of the oil control apparatus in accordance with the second embodiment of the present invention is the same as that of the oil control apparatus in accordance with the first embodiment of the present invention, descriptions thereon will be omitted.

Hereinafter, each method for controlling oil of an air conditioner in case of four, three and two compressors installed in the air conditioner in accordance with the embodiment of the present invention will now be described with reference to FIGS. 4A~6.

Figure 4A:
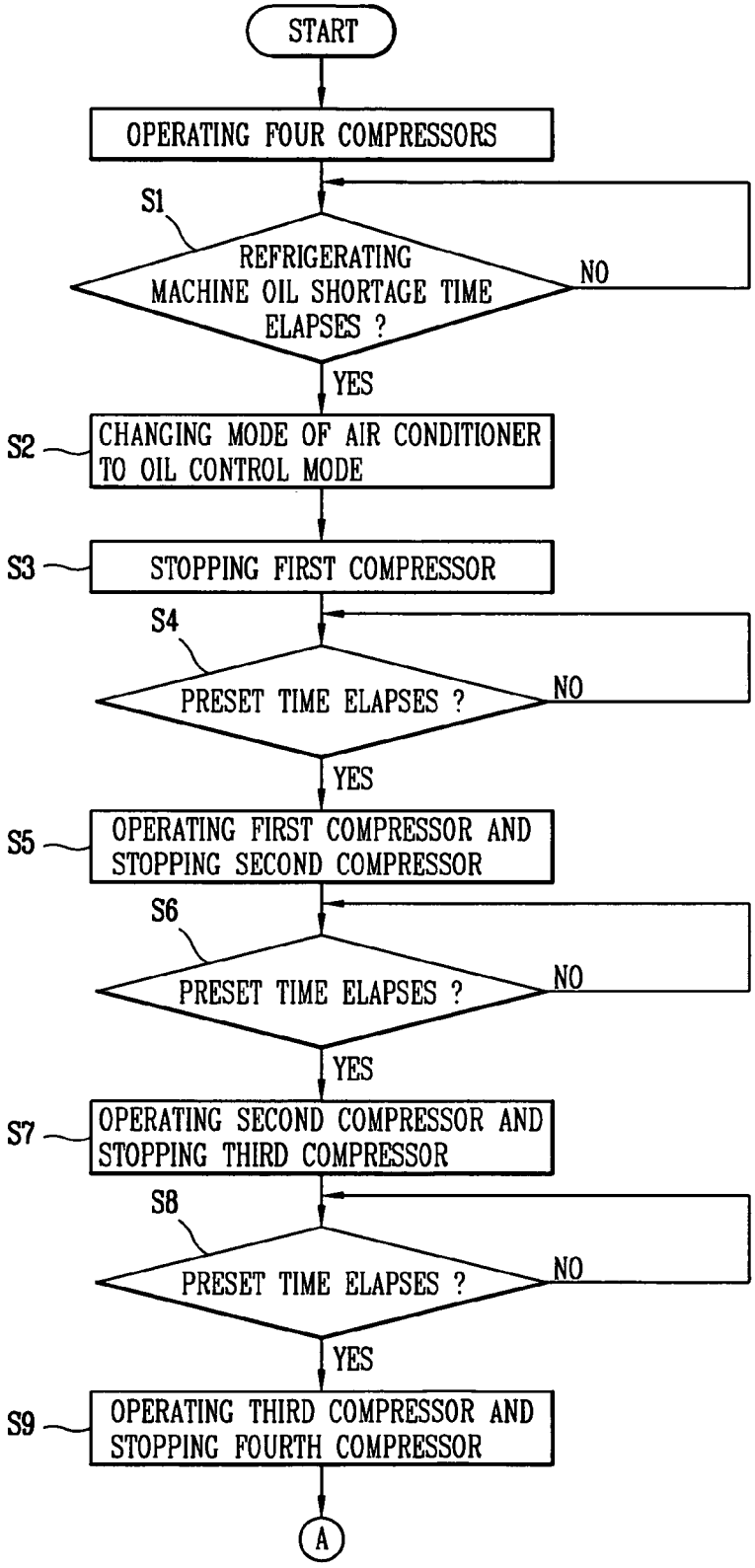
FIGS. 4A–4B are an operation flow chart of an oil control method of an air conditioner in accordance with a first embodiment of the present invention.
Figure 4B:
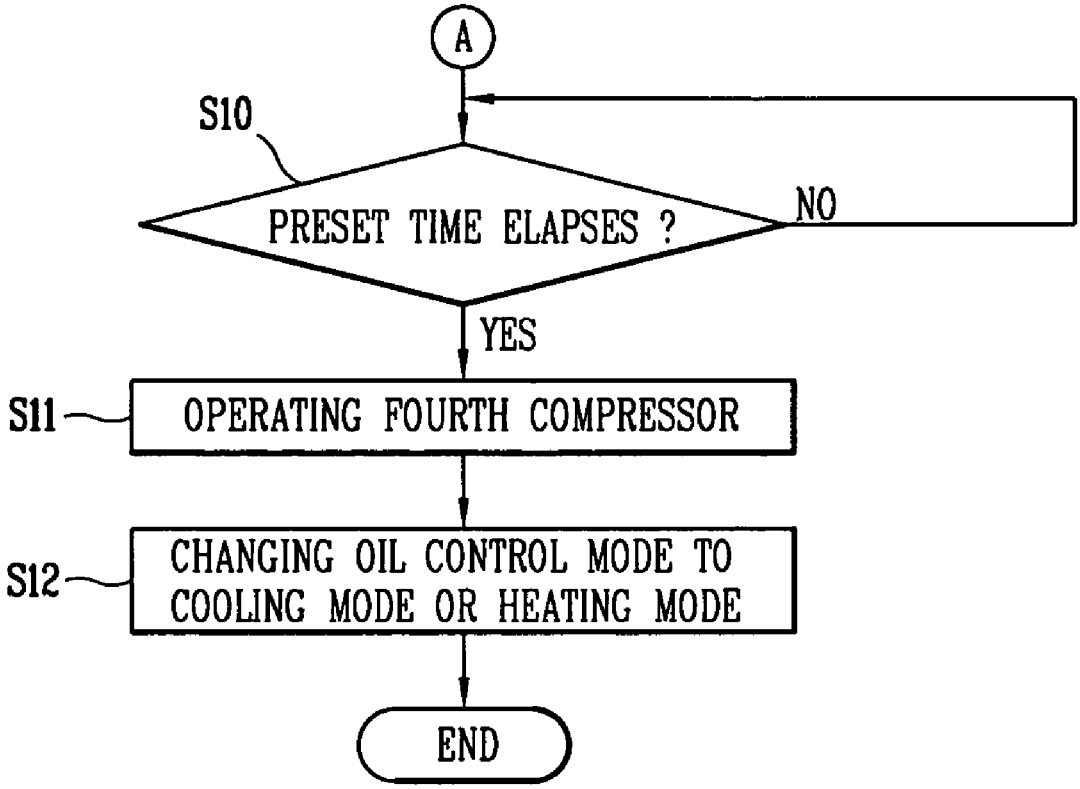

FIGS. 4A–4B are an operation flow chart of an oil control method of an air conditioner in accordance with the first embodiment of the present invention. That is, FIG. 4 describes an oil control method of an air conditioner when four compressors are installed in the air conditioner in accordance with the embodiment of the present invention in detail.

As shown therein, an oil control method of an air conditioner in accordance with the first embodiment of the present invention includes the steps i 5 of: comparing an operation time of each of the first~fourth compressors 1~4 and a refrigerating machine oil shortage time that is preset according to the number of compressors, while the first~fourth compressors are operated in a cooling mode or a heating mode; changing a mode of the air conditioner to an oil control mode when the operation time of each of the first~fourth compressors 1~4 passes the preset refrigerating machine oil shortage time, and then stopping the first compressor 1 for a preset stopping time (e.g., for one minute); operating the first compressor 1 when the preset stopping time elapses, and then stopping the second compressor 2 for the preset stopping time; operating the second compressor 2 when the preset stopping time elapses, and then stopping the third compressor for the preset stopping time; operating the third compressor when the preset stopping time elapses, and then stopping the fourth compressor 4 for the preset stopping time; and operating the fourth compressor 4 when the preset stopping time elapses, and then changing the oil control mode to the cooling mode or the heating mode.

First, the microcomputer determines whether the operation time of each of first~fourth compressors elapses the preset refrigerating machine oil shortage time while the first~fourth compressors 1~4 are operated in a cooling mode or a heat mode of the air conditioner. Herein, the preset refrigerating machine oil shortage time means a time at which a compressor (e.g., first compressor) which has insufficient refrigerating machine oil may be damaged as the refrigerating machine oil in the first~fourth compressors 1~4 is non-uniformly distributed when the first~fourth compressors 1~4 are operated for many hours. In addition, preferably, the refrigerating machine oil shortage time is set to be two-hour when four compressors are installed in the air conditioner (S1).

When the operation time of each of the first~fourth compressors 1~4 passes the preset refrigerating machine oil shortage time, the microcomputer changes a mode of the air conditioner to an oil control mode. Herein, the oil control mode is for uniformly dividing the oil in the first~fourth compressors 1~4 when the operation time of each of the first~fourth compressors passes the refrigerating machine oil shortage time (e.g., two-hour) (S2).

Thereafter, when the mode of the air conditioner is changed to the oil control mode, the microcomputer stops the first compressor 1 for a preset stopping time. Herein, preferably, the preset stopping time is one minute (S3).

When the preset stopping time elapses (S4), the microcomputer operates the first compressor 1 and then stops the second compressor 2 for the preset stopping time (S5).

When the preset stopping time elapses (S6), the microcomputer operates the second compressor 2, and then stops the third compressor for the preset stopping time (S7).

When the preset stopping time elapses (S8), the microcomputer operates the third compressor 3 and then stops the fourth compressor 4 for the preset stopping time (S9).

Thereafter, when the preset stopping time elapses (S10), the microcomputer operates the fourth compressor 4 (S11) and then changes the oil control mode to the cooling mode or the heating mode (S12). In addition, when the operation time of each of the first~fourth compressor 1~4 passes the preset refrigerating machine oil shortage time while the first~fourth compressors 1~4 are operated in the cooling mode or the heat mode of the air conditioner, the microcomputer changes the cooling mode or the heat mode of the air conditioner to the oil control mode, so that the refrigerating machine oil in the first~fourth compressors 1~4 is uniformly distributed.

Hereinafter, an oil control method of an air conditioner in accordance with a second embodiment of the present invention will now be described in detail with reference to FIG. 5.

Figure 5:
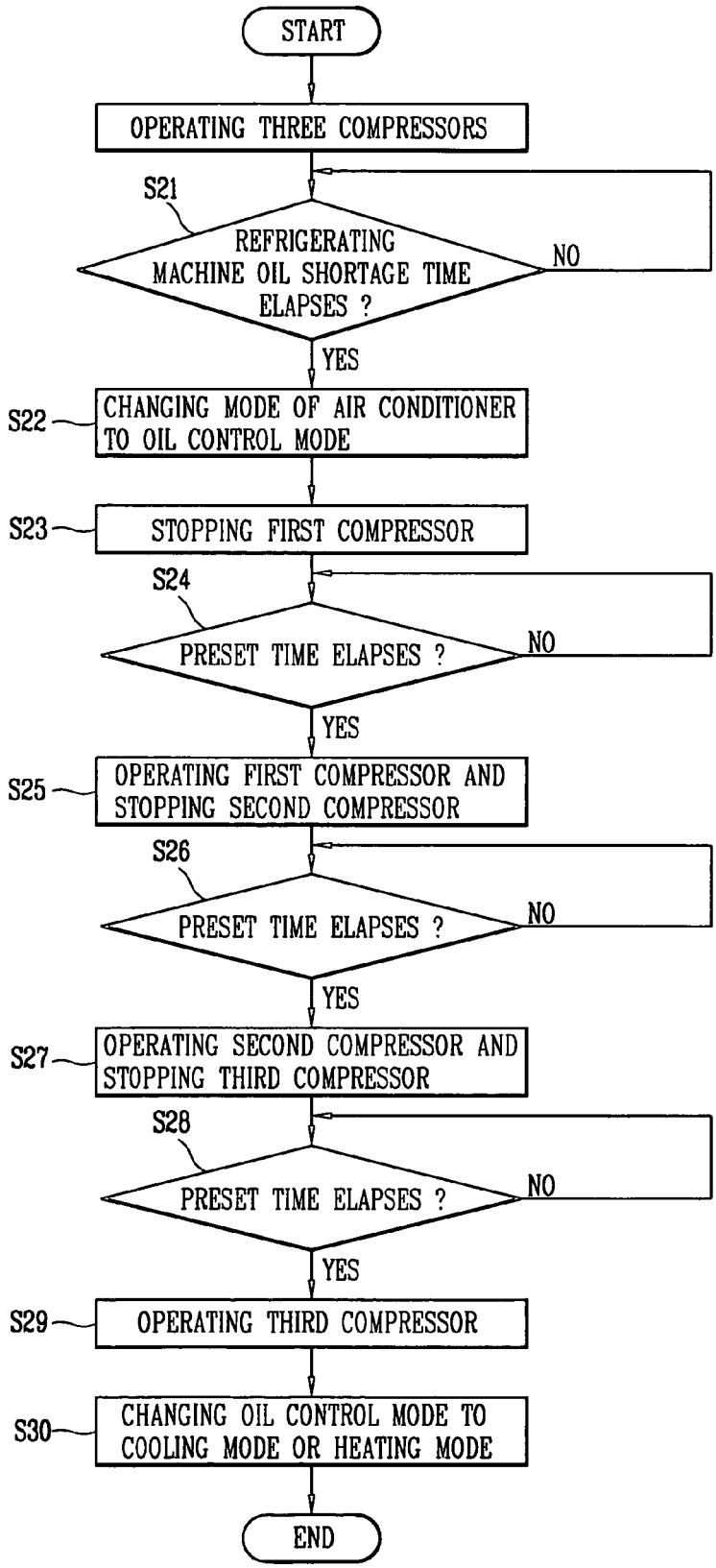
FIG. 5 is an operation flow chart of an oil control method of an air conditioner in accordance with a second embodiment of the present invention.

FIG. 5 is an operation flow chart of an oil control method of an air conditioner in accordance with the second embodiment of the present invention. That is, an oil control method of an air conditioner when three compressors are installed in the air conditioner in accordance with the embodiment of the present invention will now be described in detail.

As shown therein, the oil control method of the compressors installed in the air conditioner in accordance with the second embodiment of the present invention includes: a step in which it is determined whether an operation time of each of first~third compressors 1~3 passes a refrigerating machine oil shortage time preset according to the number of compressors (three compressors) while the first~third compressors 1~3 are operated in a cooling mode or a heating mode of the air conditioner (S21); a step in which a mode of the air conditioner is changed to an oil control mode when the operation time of each of the first~third compressors passes the preset refrigerating machine oil shortage time, and then the first compressor 1 is stopped for a preset stopping time (e.g., one minute) (S22, S23); a step in which when the preset stopping time elapses (S24), the first compressor 1 is operated, and then the second compressor 2 is stopped for the preset stopping time (S25); a step in which when the preset stopping time elapses (S26), the second compressor 2 is operated, and then the third compressor 3 is stopped for the preset stopping time (S27); a step in which when the preset stopping time elapses (S28), the third compressor 3 is operated (S29), and then the oil control mode is changed to the cooling mode or the heating mode (S30). Herein, since an operation according to the oil control method of the air conditioner in accordance with the second embodiment of the present invention is the same as that of the oil control method of the air conditioner in accordance with the first embodiment of the present invention, descriptions thereon will be omitted.

Hereinafter, an oil control method of an air conditioner in accordance with a third embodiment of the present invention will now be described in detail with reference to FIG. 6. That is, an oil control method of an air conditioner when two compressors are installed in the air conditioner in accordance with the embodiment of the present invention will now be described in detail.

Figure 6:
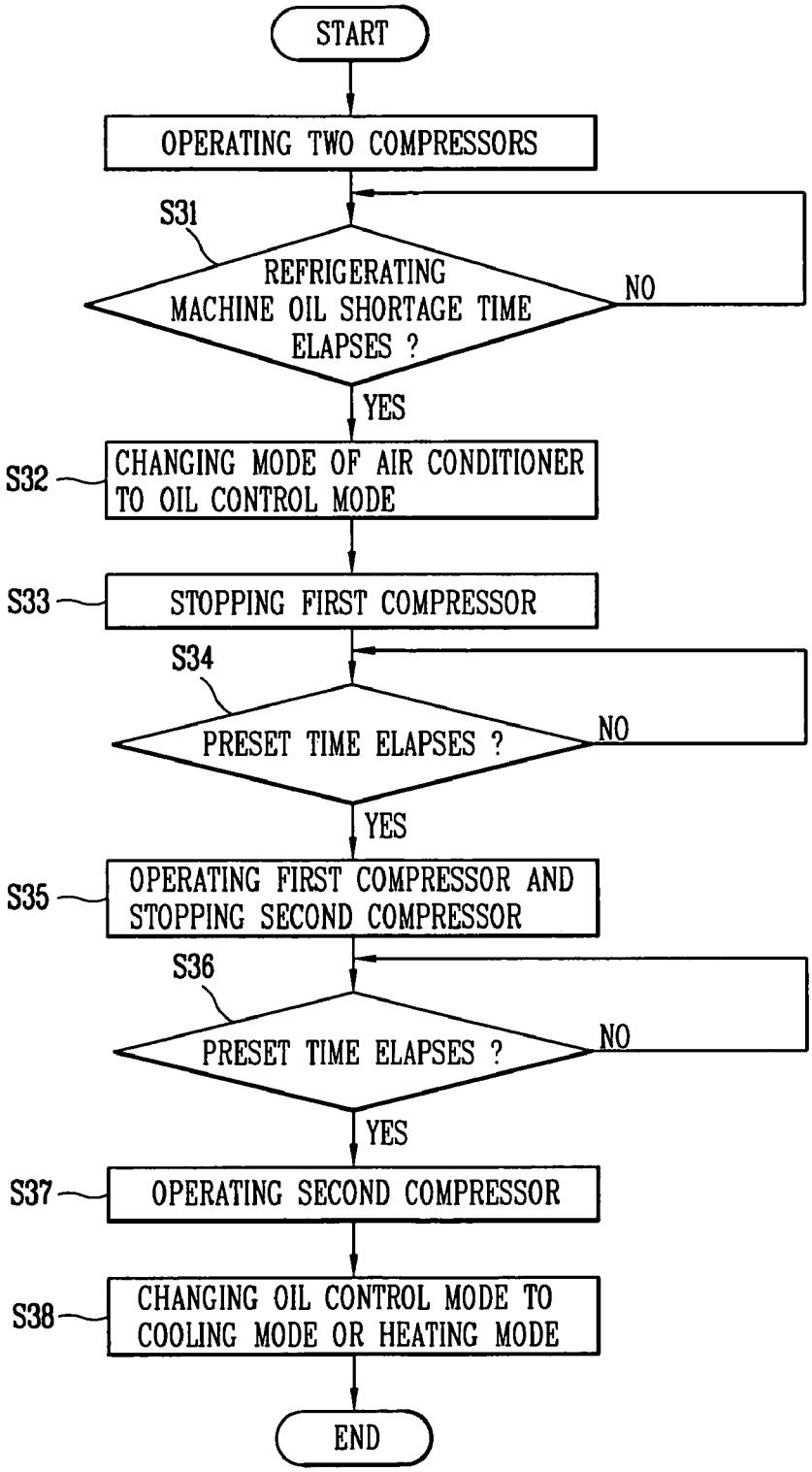
FIG. 6 is an operation flow chart of an oil control method of an air conditioner in accordance with a third embodiment of the present invention.

FIG. 6 is an operation flow chart of an oil control method of an air conditioner in accordance with a third embodiment of the present invention.

As shown therein, the oil control method of compressors installed in the air conditioner in accordance with the third embodiment of the present invention includes: a step in which it is determined whether an operation time of each of first and second compressors 1, 2 passes a refrigerating machine oil shortage time preset according to the number of compressors (two compressors) while the first and second compressors are operated in a cooling mode or a heat mode of the air conditioner (S31); a step in which a mode of the air conditioner is changed to an oil control mode (S32) when the operation time of the first and second compressors 1, 2 passes the preset refrigerating machine oil shortage time, and then the first compressor 1 is stopped for a preset stopping time (e.g., one minute) (S33); a step in which when the preset stopping time elapses (S34), the first compressor 1 is operated, and then the second compressor 2 is stopped for the preset stopping time (S35); and a step in which when the preset stopping time elapses (S36), the second compressor is operated (S37) and then the oil control mode is changed to the cooling mode or the heating mode (S38). Herein, since an operation according to the oil control method of the air conditioner in accordance with the third embodiment of the present invention is the same as that of the oil control method of the air conditioner in accordance with the first embodiment of the present invention, descriptions thereon will be omitted.

As so far described, in an apparatus and a method for controlling oil of an air conditioner in accordance with the present invention, compressors installed in the air conditioner are sequentially stopped when a mode of the air conditioner is changed to an oil control mode, and the compressors are sequentially operated when the preset time elapses, so that refrigerating machine oil in the compressors can be uniformly distributed through oil pipes connected to the compressors. That is, in the apparatus and method for controlling oil of the air conditioner in accordance with the present invention, refrigerating machine oil in the compressors is uniformly distributed, so that damage of the compressor having insufficient refrigerating machine oil due to non-uniform division of the refrigerating machine oil in the compressors when the compressors are operated for many hours can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling oil of an air conditioner, comprising:

a microcomputer that sequentially stops compressors installed in the air conditioner for a preset time when an operation time of the air conditioner passes a preset time and thus a mode of the air conditioner is changed to an oil control mode, and then sequentially operates the compressors when the preset time elapses;

oil pipes, connected to the compressors, that balance oil in the compressors; and an equalizer that maintains internal pressure of the compressors the same in order to smoothly balance oil in the compressors.

2. A method of controlling oil of an air conditioner, comprising:

comparing an operation time of each compressor and a preset refrigerating machine oil shortage time while the compressors are operated in a cooling mode or a heat mode of the air conditioner;

changing a mode of the air conditioner to an oil control mode when the operation time of the compressors passes the preset refrigerating machine oil shortage time, and then sequentially stopping the compressors for a preset stopping time; and sequentially operating the compressors when the preset stopping time elapses, and then changing the oil control mode to the cooling mode or the heating mode, wherein the compressors are connected to each other through oil pipes.

* * * * *